US005632199A

United States Patent [19]

Molitorisz et al.

[11] Patent Number: 5,632,199

[45] Date of Patent: May 27, 1997

[54] COMPACTOR

[76] Inventors: Joseph Molitorisz, 15326 SE. 43rd Pl., Bellevue, Wash. 98006; Reuben J. Smith, 23004 Hwy. 9, Woodinville, Wash. 98072

[21] Appl. No.: 562,572

[22] Filed: Nov. 24, 1995

[51] Int. Cl.[6] ..... B30B 9/30

[52] U.S. Cl. ..... 100/100; 100/3; 100/218; 100/229 A; 100/269.06; 100/269.11

[58] Field of Search ..... 100/3, 34, 46, 100/100, 218, 229 A, 258 R, 258 A, 269.06, 269.11

[56] References Cited

U.S. PATENT DOCUMENTS

| | | | |
|---|---|---|---|
| 2,565,639 | 8/1951 | Waldie | 100/46 |
| 4,057,009 | 11/1977 | Burford et al. | 100/46 |
| 4,273,037 | 6/1981 | Ruebesam | 100/229 A |
| 5,448,945 | 9/1995 | Taylor et al. | 100/100 |

*Primary Examiner*—Stephen F. Gerrity

[57] ABSTRACT

Hydraulically activated compactor with internal storage and integrated removable container-lift, having automatic angularity control for the platen bar, forming bales of waste and refuse material.

4 Claims, 3 Drawing Sheets

COMPACTOR

BACKGROUND OF THE INVENTION.

Disposal of refuse and waste material is a major environmental concern in the industrial world. Handling and disposal of such material in commercial operations, such as hotels, restaurants, fast-food industries, cafeterias, shops and other establishments requires packaging. It is usually collected for disposal in light-gauge plastic bags, which are called in this application as "primary bag" and the loaded bags are inserted into more durable heavier gauge plastic bags, which are called "secondary bag", for handling. The primary and secondary bags, together with the waste material are disposed of at the disposal site. To reduce the volume of the disposed refuse, or waste material, in some operations compacting is applied.

SUMMARY OF THE INVENTION.

This invention is directed to useful, economical and safe disposal of refuse and waste material. It is applicable to refuse, or waste material composed of mainly dry substance, or containing mixture of dry substance and limited amount of liquids usually found in waste of restaurants, hotels and the like. It provides an apparatus with which the volume of the waste material is reduced significantly by densification under compacting, and the reduced volume is maintained in tied bales, or bale like bundles. In case of dry substance with sufficient physical dimension and cohesiveness, bales can be made without the use of primary or secondary bags. For material made up of shorter physical dimension, and lacking cohesiveness, bags are necessary to hold together the bale after tying with twine. For restaurants and hotel waste, which is usually collected in light gauge primary plastic bags, the filled bags can be compacted into dense bales. For waste material with more liquid content, the individual light gauge primary bags have to be placed into heavier gauge water-tight secondary bags for reduction or elimination of spilling of the liquids during and after compacting. Retaining the high density of the tied bale or bundle increases the weight of the disposed material in the bag, thus reduces the number of bags needed, reducing the amount of the non-decomposing plastic at the final disposal site. This is significant for environmental consideration.

In a typical restaurant, or hotel operation the waste material is collected in light gauge plastic primary bags at several locations. The filled bags are put into larger heavier gauge secondary bags, and are moved to a temporary storage bin, before final disposal. The relatively low density of the waste material in the bags results in large volume. Reduction of the volume can be achieved by compacting the loose waste material after loading into the bags. However, releasing the compacting force without installing tying means, allows expansion, resulting in lower final density and in large volume.

In this invention the filled light gauge primary bags are placed and stored in the enclosed confinement of the compacting apparatus for periodic compacting. The cabinet-like structure of the compacting apparatus provides sufficient volume for storing several of the bags before compacting, and allows the adding of more bags with each periodic compacting, until the desired density and size of the bale is achieved. The method also includes the tying of the compacted material while in its fully compressed state, with twine, strap or wire, to retain the final density, and to form stable bales or bundles for handling.

The installation of the tying material around the compressed waste material includes placing the twine into the container of the container-lift assembly of the compacting apparatus prior to loading the waste material. It is arranged and held in place along two opposite sides and the bottom of the container. The two ends of the tying material are secured to the container walls or to the walls of the compactor. To retain its position at the bottom of the container, cardboard, or other suitable means is used to hold the tying material. The tying material can be applied internally, or externally to the secondary bag, if used.

The cycle of the operation is as follows; the platen of the compactor is moved hydraulically to its upper-most position, the loading doors of the compactor are opened, the container-lift assembly of the apparatus is inserted into the cavity of the compacting apparatus, and is secured. The retaining twine is installed along the two sides and the bottom of the container, and its two ends are removably attached to the container, or to the walls of the compactor cabinet. The waste material, or the primary bags filled with the waste material, if used, are placed into the container and the internal cavity of the compactor. After closing the loading doors the platen is activated hydraulically moving downward, compressing and forcing the bags into the container. This operation can be repeated until the container is filled with fully compacted waste material, or primary bags. When the final bale size is achieved, the platen is moved downward as far as it can and the loading doors of the compactor are opened. The two ends of the twine are released and are fed through the slot of the platen on top of the bale, and are tied together to form a closed loop around the compacted material, forming a bale, or bundle. After tying the twine, the loading doors of the compactor are closed, allowing the activating of the platen, moving it to its uppermost position. The container-lift assembly is released and is removed from the compactor cabinet together with the compacted and tied bale. The container-lift assembly is wheel mounted for easy moving of the bale to the temporary disposal site, such as a bin, or dumpster. The container is lifted by the lifting mechanism of the container-lift assembly to the desired height, at which the hinged front door and bottom plate of the container are released, allowing the dumping of the bale into the bin. The bale having a nearly cube shape provides efficient utilization of the volume of the bin.

The above described method and apparatus provides the following unique and novel features of the invention;

(a), the refuse or waste material to be compacted is stored inside the enclosed confinement of the compacting apparatus, away from traffic routes, resulting in improved operational safety, (b), the probability of spilling is reduced resulting in improved sanitation, (c), excess to insects and rodents is reduced resulting in improved working conditions and sanitation, (d), dispersion of undesirable odor is reduced resulting in improved working conditions, (e), with achieving high final density for the compacted refuse, or waste material, and retaining the high density by tying it into bales or bundles, the volume requirement at the disposal site is reduced, (g), the danger of bodily injury by objects, such as glass, when breaking up under the compacting forces inside the enclosed confinement of the compacting apparatus, is eliminated, (h), spilling of liquids from breaking, or collapsing containers, while being compacted inside the enclosed confinement of the compacting apparatus, is reduced, (i), the probability for spilling during transfer from the compacting apparatus to the temporary storage bin or dumpster, is reduced, (j), in case of using water-tight secondary plastic bags, the number of the necessary bags is reduced by the increased density of the compacted waste material resulting in lower operating cost and in lesser amount of non-decomposing plastics at the disposal site.

PREFERRED EMBODIMENT.

Figure 1:
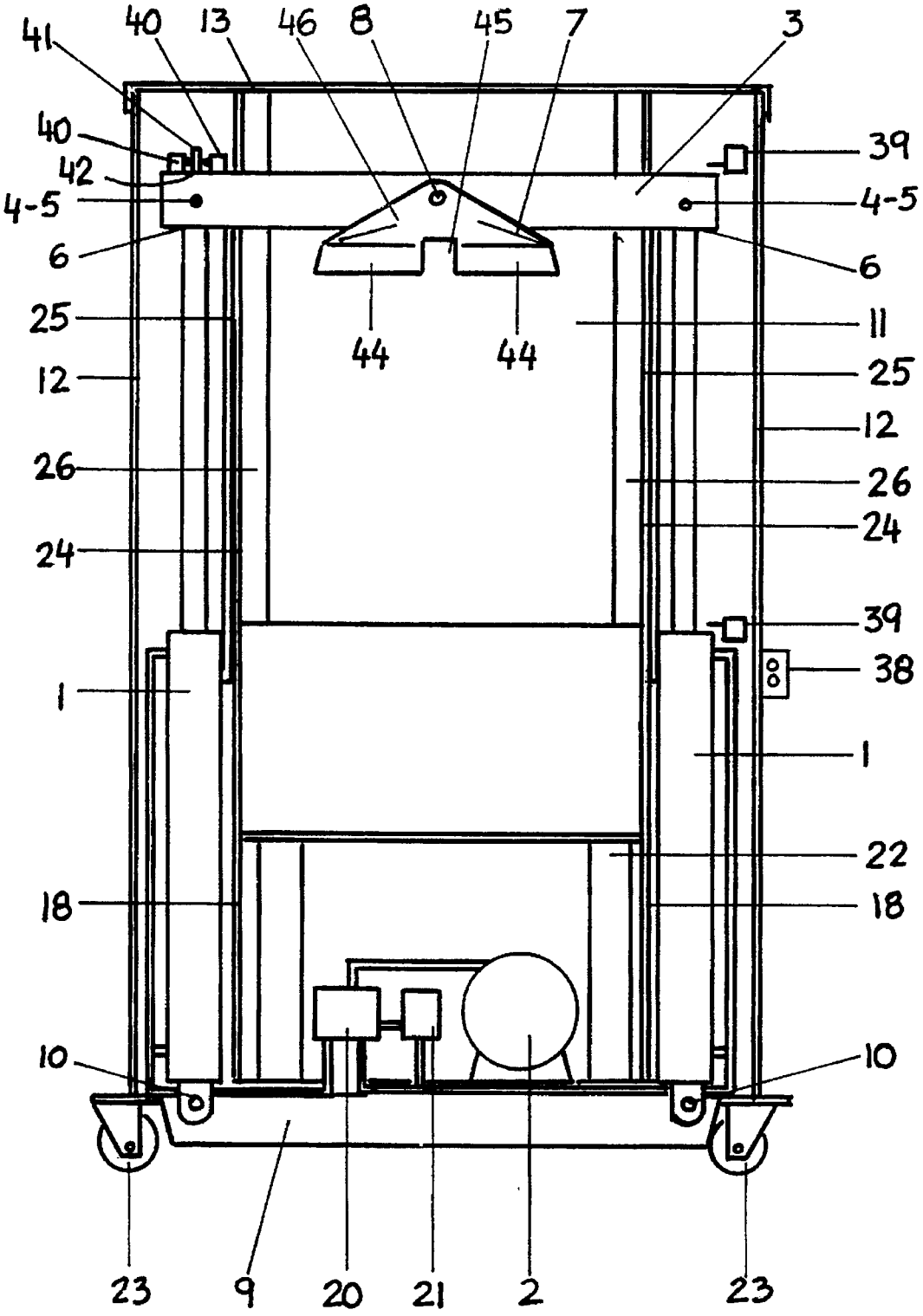
FIG. 1. is a cross-sectional elevation of the compactor.
Figure 2:
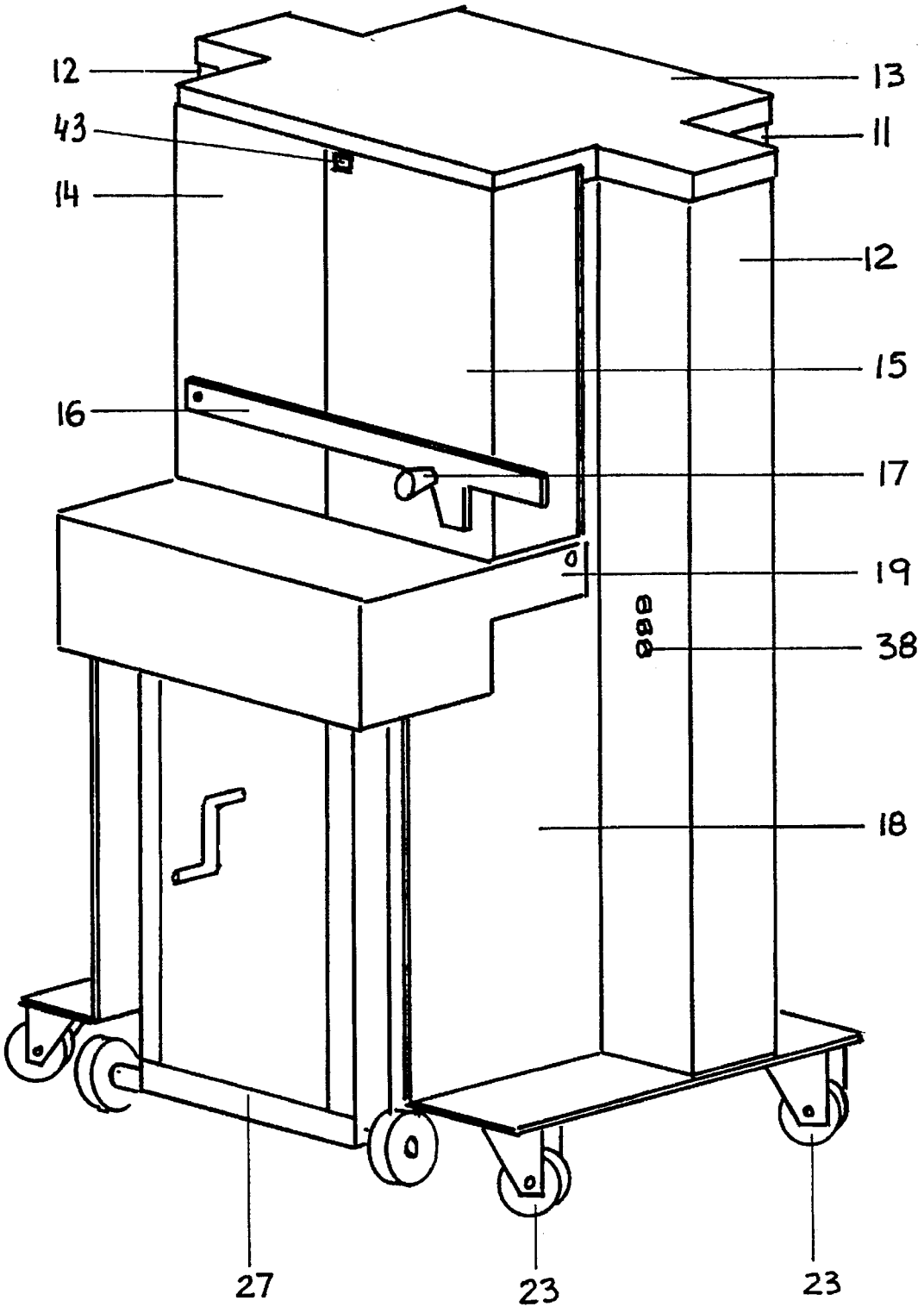
FIG. 2. is an isometric diagram of the compactor assembly.
Figure 3:
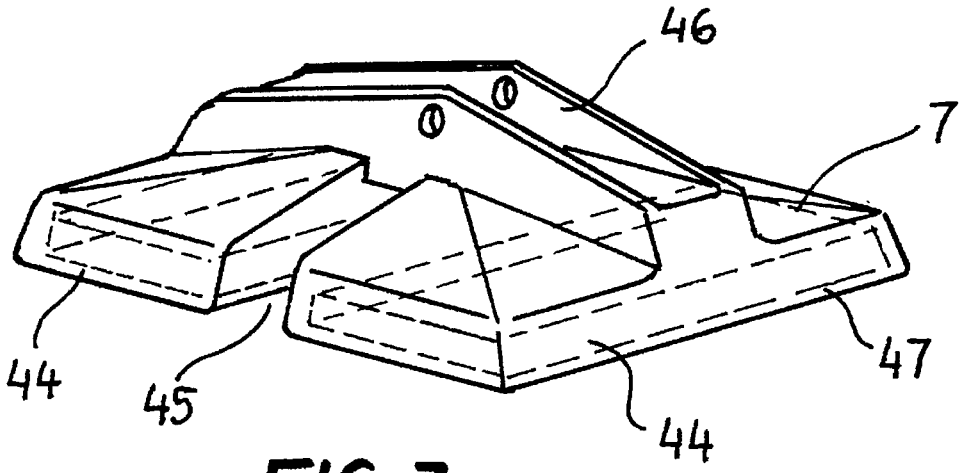
FIG. 3. is an isometric diagram of the platen.

The compactor comprises; two double acting hydraulic cylinders (1) which are connected to the hydraulic power unit (2) in a parallel hydraulic circuit for simultaneous activation, shown on FIG. 1. The cylinders are parallel to each other, and are in a vertical plane. The platen bar (3) at or near its opposite ends is attached to the rods of both cylinders by pins (4), which are inserted through the holes (5). The holes (6) through which the cylinder rods are inserted are sized allowing limited angularity of the platen bar relative to the cylinder rods in the common plane of the longitudinal axes of cylinder rods. The platen (7) is attached to the platen bar by the pin (8). The platen and platen bar assembly moves in the vertical plane under the action of the hydraulic cylinders (1). The platen, shown on FIG. 3, is an aluminum casting. It has two rectangular compacting plates (44) and a slot (45) between the plates. The two compacting plates (44) are connected by a bridge structure (46). The bridge has two side walls enclosing an open channel for the insertion of the platen bar (3). The side walls have a hole for the insertion of a pin (8) to secure it to the platen bar. The compacting plates (44) have downward extended angular rims (47) to force the material under compacting away from the inside walls of the compactor cabinet. The top surface of the platen is sloping toward the outer edges to prevent accumulation of material. The cylinders (1) are attached to the frame of the compactor (9) by the pins (10), allowing limited angular motion in the common vertical plane of the longitudinal axes of the cylinders. The cabinet of the compactor, shown on FIG. 2, has a rear wall (11), two side channels (12) to cover the cylinders, top cover (13), the hinged doors (14) and (15), the door latch arm (16) and knob (17), side plates (18) and the hinged container-lift assembly cover (19).

The hydraulic power unit (2), shown on FIGURE 1, is installed inside the cabinet on the frame (9) together with the directional control valve (20) and two solenoid operated on-off valves (21). The table (22) is removably installed in the cabinet, covering the power unit and the valves. The frame (9) has four caster wheels (23).

The slots (24) on the cabinet side walls for the vertical movement of the platen bar (3) are covered by sliding bars (25) made of plastic flat bar, and are attached to the platen bar (3) to move with it. The upper portion of the cabinet and the doors (14) and (15) are lined on the inside walls with plastic sheets (26).

Figure 4:
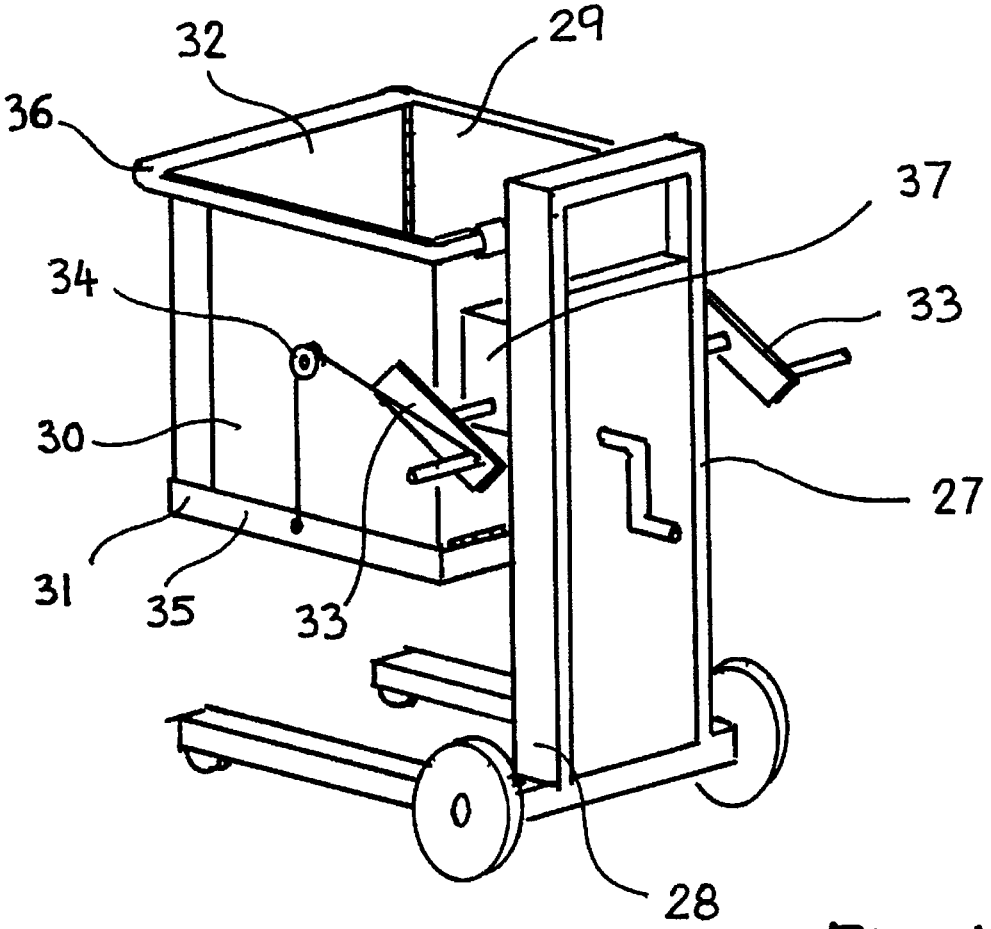
FIG. 4. is an isometric diagram of the container-lift assembly.

The container-lift assembly (27), shown on FIG. 4, comprises; the lift (28) and the container (29). It is removably inserted into the lower section of the cabinet placing the container on top of table (22), and is held in place by the lift cover assembly (19), shown on FIG. 2. The container is removably attached to the lift. The container, shown on FIG. 4, comprises; three side walls (30), the hinged bottom plate (31) and the hinged door (32). The bottom plate is held in position by the pivoted rod and cable assembly (33) and the pulley (34). The pivot point of the rods (33) is placed on the container to reach an over-the-center position, locking the door in its closed position. Releasing the rod (33) from the over-the-center position allows the dropping of the bottom plate. The hinged door (32) is held in its closed position by the upward rim (35) of the bottom plate (31), and the hinged tubular rim (36). The container assembly is removably attached to the lift by the bracket (37). The lift (28) has a winch operated cable mechanism to raise and lower the container.

The compactor is operated hydraulically and is controlled electrically. The switches (38) control the solenoid operated hydraulic directional control valve for the up and down movement of the cylinder rods. The limit switches (39) stop the motion of the platen bar in both up and downward directions.

To control the angularity of the platen bar (3) in its downward motion, two electric switches (40) are installed on the platen bar, shown on FIG. 1. The switches are activated by the pin (41) which is attached to the upper end of the cylinder rod, and protrudes through the slot (42) of the platen bar. With the angularity of the platen bar relative to the cylinder rod, one of the switches is activated. The activated switch energizes the on-off hydraulic valve in the hydraulic circuit cutting off the flow of the hydraulic fluid to the port of the cylinder which is leading the other cylinder in the downward motion. With the cutting-off the flow to the leading cylinder the flow to the lagging cylinder increases, resulting in rapid correction of the level of the platen bar. The maximum angularity of the platen bar is adjustable by adjusting the position of the electric switches. The controlled angularity of the platen bar is also applied to increase the magnitude of the compacting forces on the material when the distribution of the material in the container is uneven by holding the rod of the leading cylinder in a locked position, while moving the other cylinder rod downward. The pin (4) of the locked cylinder serves as pivot point for the platen bar, adding a lever advantage for the active cylinder relative to the platen. The controlled angularity of the platen bar (3) and of the platen (7) also serves as means to exert lateral forces on the compacted material for better distribution in the container.

The electric circuit of the compactor is controlled by an electric switch (43) which is activated by the doors, such that the solenoid operated hydraulic direction control valve (20) can not be energized when the doors are open.

While the invention has been described and illustrated, it should be understood that changes may be made without departing from the principles thereof, accordingly the invention is to be limited by the literal interpretation of the claims appended thereto.

We claim:

1. A compactor for densification and packaging of refuse and waste material into bales, said compactor comprising:

cabinet having an upper opening for receiving waste into the cabinet and a lower opening;

a container-lift assembly removably received within the cabinet through the lower opening for storing the refuse and waste material therein;

a hydraulically activated and automatically-electrically controlled compacting platen bar and platen assembly supported within the cabinet for reciprocating movement for compacting the refuse and waste within the container-lift assembly;

a hydraulic activating means for reciprocating the compacting platen bar and platen assembly;

an automatic-electric control means for controlling the hydraulic activating means in order to control reciprocation of the compacting platen bar and platen assembly;

wherein the compacting platen bar and platen assembly further comprises a platen formed from two plates separated by an open slot, the plates being held together by a bridge, the plates having rims which each extend downward at an angle, the platen being attached to the platen bar at the bridge, the platen having an upper surface which extends downward at an angle toward the respective sides of the platen.

2. A compactor of claim 1 comprising:

wherein the container assembly comprises a lift and a container removably attached to the lift, the lift being one of manually or power activated for raising and lowering the container, the container comprising three side walls, a front door hinged to one of the side walls for pivoted movement between opened and closed positions, a bottom plate hinged to one of the side walls and including an upward extending rim, a tubular rim hinged to one of the side walls, and a mechanism for releasing the hinged bottom plate to permit the bottom plate to pivot, the hinged front door being held in its closed position by the upwardly extending rim of the hinged bottom plate and by the hinged tubular rim, the hinged front door being released by pivotally lifting the hinged tubular rim, and by releasing the hinged bottom plate, thereby permitting the hinged bottom plate to be pivoted and the hinged front door to be pivoted to its opened position.

3. A compactor of claim 1 further comprising a frame for supporting the compactor, wherein the automatic-electric control means for the hydraulic activating of the compacting platen bar and platen assembly further comprises two hydraulic cylinders pivotally attached to the frame of the copactor and the cylinders are substantially parallel to each other in a substantially vertical plane, the platen bar being pivotally attached to rods of the hydraulic cylinders, the hydraulic cylinders being activated by pressurized hydraulic fluid for upward and downward movement of the platen bar and platen assembly, a hydraulic power unit to pressurize the hydraulic cylinders, electrically activated valves to control the flow of the hydraulic fluid to and from the hydraulic cylinders.

4. A compactor of claim 3 comprising:

wherein the automatic electric control means for the hydraulic activating of the platen bar and platen assembly further comprises an automatic-electric control means for the angular positioning of the platen bar, having electric switches mounted on the platen bar and the switches being activated alternatively by the angular position of the platen bar relative to the longitudinal axis of the said hydraulic cylinder rods, the electric switches activating hydraulic valves to stop the flow of the pressurized hydraulic fluid to the cylinder the rod of which leads the rod of the other cylinder, directing the flow of the pressurized fluid to the cylinder the rod of which lags in their retracting actions, the electric switches being adjustable for maintaining the desired angular position of the platen bar, the electrically-automatically adjusted angular position of the platen bar and platen assembly being utilized for increased compacting forces.

* * * * *